United States Patent [19]

Thomas

[11] Patent Number: 4,686,920

[45] Date of Patent: Aug. 18, 1987

[54] CRADLE TYPE BOAT LIFTS

[76] Inventor: James L. Thomas, 1081 35th Ave., Vero Beach, Fla. 32960

[21] Appl. No.: 934,330

[22] Filed: Nov. 24, 1986

[51] Int. Cl.[4] ..... B63C 1/08

[52] U.S. Cl. ..... 114/48; 114/45; 114/51; 405/3; 405/4

[58] Field of Search ..... 114/258, 259, 44, 45, 114/48, 51, 230; 405/3, 4; 182/144

[56] References Cited

U.S. PATENT DOCUMENTS

| | | | |
|---|---|---|---|
| 3,073,125 | 1/1963 | Pearlson | 405/3 |
| 3,114,246 | 12/1963 | Collin | 405/3 |
| 3,265,024 | 8/1966 | Kranlich | 405/3 |
| 3,504,502 | 4/1970 | Blount | 405/3 |
| 3,777,691 | 12/1973 | Beale | 114/48 |
| 4,329,082 | 5/1982 | Gillis | 405/3 |

*Primary Examiner*—Jeffrey V. Nase
*Assistant Examiner*—Thomas J. Brahan
*Attorney, Agent, or Firm*—Carroll F. Palmer

[57] ABSTRACT

A boat lift for a berth having permanently positioned piles in pairs spaced apart a distance sufficient to permit the boat to be berthed thereat to move between the paired piles while in the water includes a cradle having fore and aft transverse members upon which the boat is supported out of the water, a first pair of such piles equipped with first sheaves, a second pair of such piles with second sheaves, a third pair of such piles positioned between the first and second pairs adjacent the second second pair, first and second beams carried by the inside and outside piles of the second and third piles, motor driven winch drums supported by the first and second beams, third sheaves carried by the first and second beams, first inside and outside cables reeved respectively from the first and second drums via the first and second sheaves forward to the inside and outside piles of the first pair to lift the fore transverse member of the cradle, and second inside and outside cables reeved from the winch drums via the third sheaves to lift the aft transverse member of the cradle.

6 Claims, 5 Drawing Figures

CRADLE TYPE BOAT LIFTS

BACKGROUND OF THE INVENTION

1. Field of the Invention

This invention relates to improvements in boat lifts. More particularly, it concerns novel boat lifts of the cradle type that are associated with some form of permanent berth, e.g., a dock, finger pier, seawall, or the like.

2. Description of the Prior Art

A variety of different types of boat lifts have been developed to handle various kinds of boats in different ways and locations. In a broad sense, these may be divided into mobile lifts that can lift and move boats about on land or water and permanent lifts designed to lift boats at a fixed location. This present invention relates to lifts of the second class.

The permanent location type boat lifts, particularly those designed to handle pleasure boats of modest size, e.g., boats of up to 40 feet in length and displacement up to 10,000 lbs., can be divided into two general classes, namely, (a) davit types which lift boats by cables that attach to some portion of the superstructure of the boat and (b) cradle types which lift boats by engagement of the hull of the boat from its underside once the boat has entered the berth at the permanent lift location. This invention relates to the cradle type boat lifts.

Cradle type lifts can be further subdivided into (1) ramp types in which a lift cradle moves in and out of the water on stationary ramps that extend into the water at the berth and (2) cable types in which a lift cradle is hoisted in and out of the water by cables that suspend from supports positioned at the berth above the waters. This invention relates to the cable hoist cradle boat lifts.

A number of improvements have been proposed for the cable hoist cradle boat lifts as illustrated by U.S. Pat. Nos. 2,709,345; 3,077,742; 3,265,024 and 4,329,082. However, two shortcomings have persisted with prior known lifts of this class, namely, use of extensive superstructures to support the cable systems and undesirbly high loadings imposed on the cables and their support systems. The present invention offers solutions to these problems and additional improvements in cable hoist cradle type boat lifts.

OBJECTS

A principal object of the invention is the provision of improved boat lifts of the cradle type that are associated with some form of permanent berth.

Further objects include the provision of:

1. Improved cable hoist cradle type boat lifts characterized by the lack of extensive superstructure for the support of the cable systems of the lift.

2. Such boat lifts in which significantly low tensions are imposed on the hoist cables during raising, storing or lowering of a boat on the lift.

Other ojbects and further scope of applicability of the present invention will become apparent from the detailed description given hereinafter; it should be understood, however, that that detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of improved forms boat lifts for permanent berths that include permanently positioned piles at least some of which are in pairs spaced apart a distance sufficient to permit the boat to be berthed thereat to move between the paired piles while in the water at the berth.

The improved lifts comprise a cable hoisted cradle upon which the boat can be supported out of the water which includes a first transverse member having an inside end and outside end and a second transverse member spaced apart from the first member having an inside end and outside end.

Installed at the berth are a first pair of the piles including first sheave means, a second pair of the piles including second sheave means, and a third pair of the piles positioned between the first and second pairs adjacent the second second pair. Each of the pair of piles has an inside pile and an outside pile. First and second beams are supported respectively by the inside and outside piles of the second and third pairs.

First and second motor driven winch drums are supported respectively upon the first and second beams and third sheave means are carried by the first and second beams. First inside and outside cables are reeved respectively from the first and second drums via the first and second sheave means forward to the inside and outside piles of the first pair of piles to lift the first transverse member of the cradle. Additionally, second inside and outside cables are reeved respectively via the third sheave means from the first and second drums to lift the second transverse member of the cradle.

In preferred lifts of the invention, the transverse members of the cradle carry support means to engage the hull of a boat to be lifted and such support means includes hull engaging pad members plus means to adjust the spacing of such pad members relative to the transverse members. Additionally, the motors of the driven winches are electric motors.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
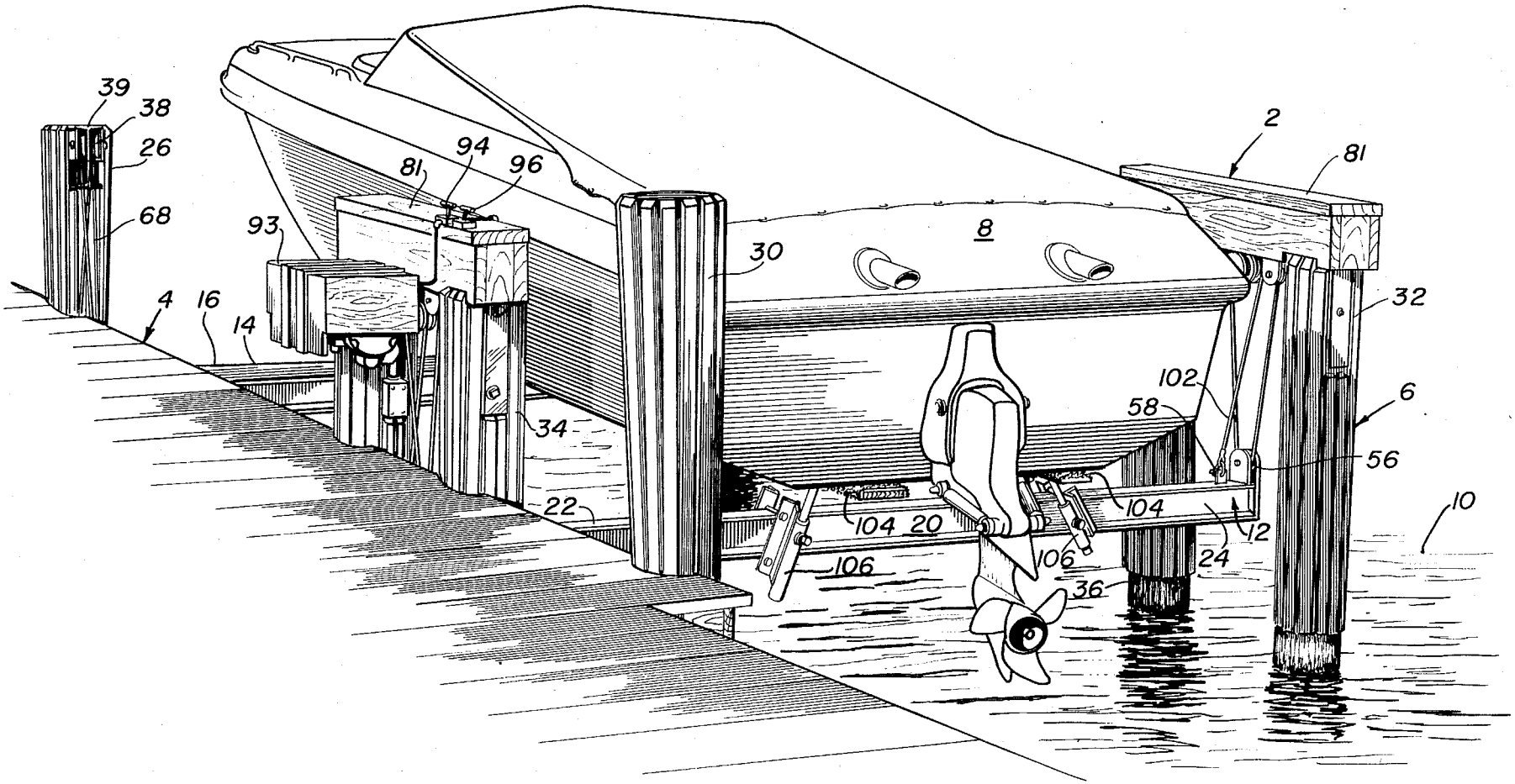
FIG. 1 is a perspective view of a boat lift of the invention supporting a inboard/outboard drive motorboat above the water at the boat's permanent berth.

Referring in detail to the drawings, in which identical parts are identically marked, the invention comprises a boat lift 2 associated with a berth 4 that includes permanently positioned piles 6 at least some of which are in pairs spaced apart a distance sufficient to permit the boat 8 to be berthed thereat to move between the paired piles while in the water 10 at the berth 4. The lift 2 comprises a cradle 12 upon which the boat can be supported out of the water 10.

The cradle 12 includes a first transverse member 14 having an inside end 16 and outside end 18. It also has a second transverse member 20 spaced apart from member 14 having an inside end 22 and outside end 24. A plank 25 is fixed to span the members 14 and 20.

The lift 2 and the berth 4 comprise first pair of piles define the fore end of the berth consisting of a first inside pile 26 and a first outside pile 28. A second pair of the piles defines the aft end of the berth 4 consisting of a second inside pile 30 and a second outside pile 32.

There is also a third pair of the piles positioned between the first and second pairs, closer to the second pair than the first pair, consisting of a third inside pile 34 and a third outside pile 36.

The inside piles 26, 30 and 34 are approximately aligned along an inside longitudinal axis and the outside piles 28, 32 and 36 are approximately aligned along an outside longitudinal axis.

A pair of first inside sheaves 38 are mounted by cantilever means 39 at the top 40 of the first inside pile 26 on the aft side 42 to rotate about a shaft 44 positioned normal to the aforesaid inside longitudinal axis. A pair of first outside sheaves 46 are similarly mounted at the top 48 of the first outside pile 28 on the aft side thereof.

A second inside sheave 50 is mounted on the first inside pile 26 below sheaves 38 and above the water 10. Similarly, a second outside sheave (not shown) is mounted on the first outside pile 28.

A third inside sheave 52 and a first inside becket 54 are mounted on the inside end 16 of member 14 and a third outside sheave 56 and a first outside becket 58 are similarly mounted on the outside end 18 of member 14.

A fourth inside sheave 60 is mounted on the third inside pile on the aft side 62 thereof approximately on the horizontal plane of the second inside sheave 50. Also, a fourth outside sheave 64 is similarly mounted on the third outside pile 36.

There is a bore 66 in the third inside pile 34 to permit a cable 68 to pass from inside sheave 60 to inside sheave 50. Similarly, there is a like bore in the outside pile 36 to permit a cable 70 to pass from outside sheave 64 to second outside sheave.

A fifth inside sheave 72 and a second inside becket 74 are mounted on the inside end 22 of transverse member 20 and, in like manner, a fifth outside sheave and a second outside becket mounted on the outside end 24 of member 20.

An inside horizontal beam 76 is supported between piles 39 and 34 above the horizonal plane of inside sheaves 50 and 60. Similarly, a outside horizontal beam 78 is supported between outside piles 32 and 36. Protective covers 81 are provided for the beams 76 and 78.

A sixth inside sheave 80 is carried by the inside beam 76 adjacent inside pile 30 on its bottom side 84. A sixth ouside sheave is similarly carried by the outside beam 78.

An inside winch drum 86 driven by electric motor 88 is carried on inside beam 76 between inside sheave 80 and inside pile 34 to rotate about an axis normal to the aforesaid inside longitudinal axis. An outside winch drum 90 driven by electric motor 92 is similarly carried on outside beam 78. Covers 93 are provided to protect the motors 88 & 92 from the elements.

The inside cover 81 for beam 76 carries electric switch means 94 is connected to motor 88 to control its operation, and in turn the cw. and ccw. rotation of the drum 86. Likewise, cover 81 carries second switch means 96 connected via the electric wiring 98 to the motor 92 to similarly control its operation and also the winch 90.

The cable 68 is reeved from the inside winch 86 seriatim through sheaves 60, 50, 38, 52 and 38 terminating at inside becket 54. Similarly, the cable 70 is reeved from the outside winch 90 through comparable outside sheaves to terminate at the outside becket 58.

Another cable 100 is reeved from winch 86 seriatim through sheaves 72 and 80 to terminate at inside becket 74 and a cable 102 is similarly reeved from winch 90 through outside sheaves to terminate at the second outside becket 58.

The brackets 39, beams 76 etc. are advantageously made of galvanized steel, stainless steel, aluminum or equivalent material. Preferably, the various sheaves, 38, etc. are formed from stainless steel, but other materials, e.g., galvanized steel, may be used. While specific structures for such parts have been shown in FIGS. 1 and 2, those skilled in the art will recognized that equivalent items are commercially available or can be fabricated for use in constructing boat lifts in accordance with the invention.

Figure 3:
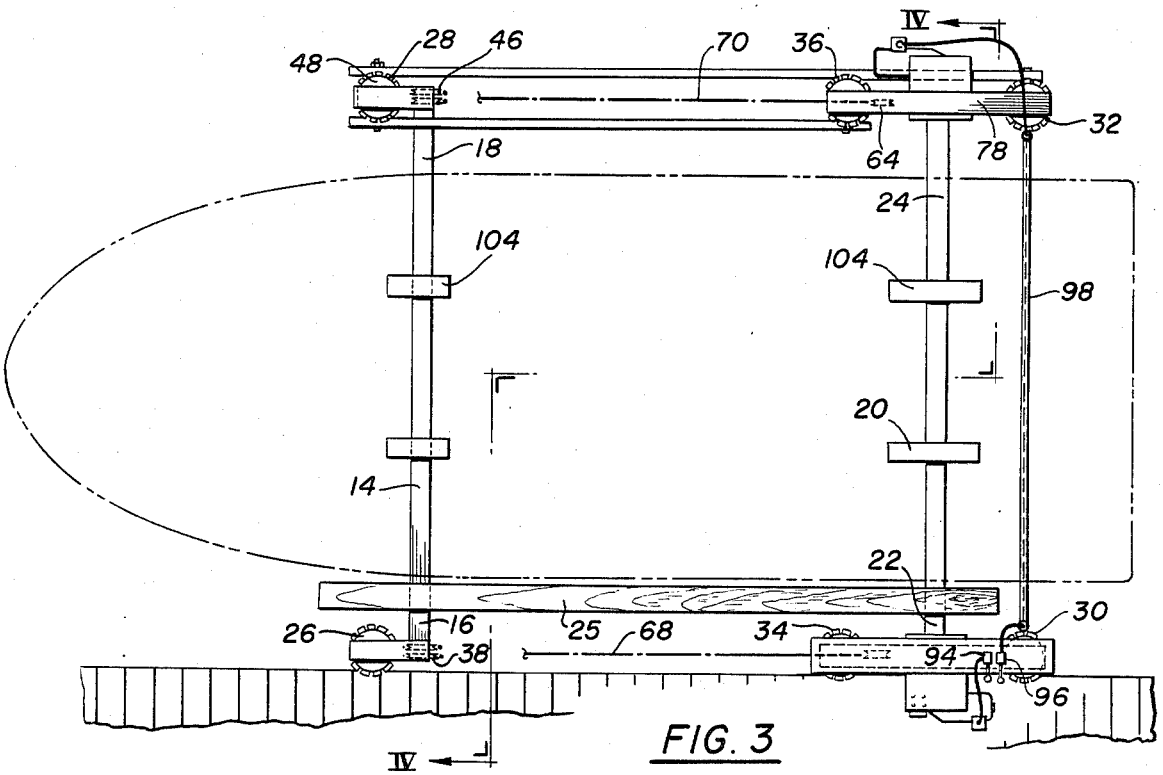
FIG. 3 is a plan view of the berth and boat lift of FIG. 1 with the berthed boat shown in phantom.
Figure 4:
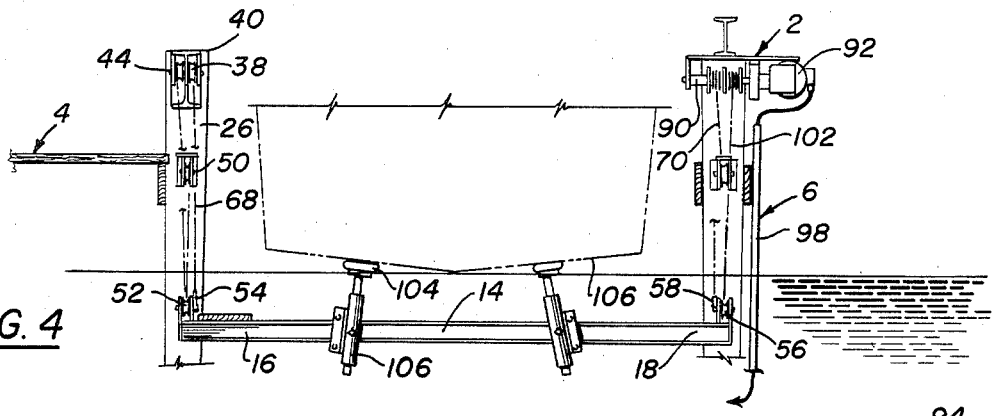
FIG. 4 is a sectional view taken on the line IV—IV of FIG. 3.
Figure 5:
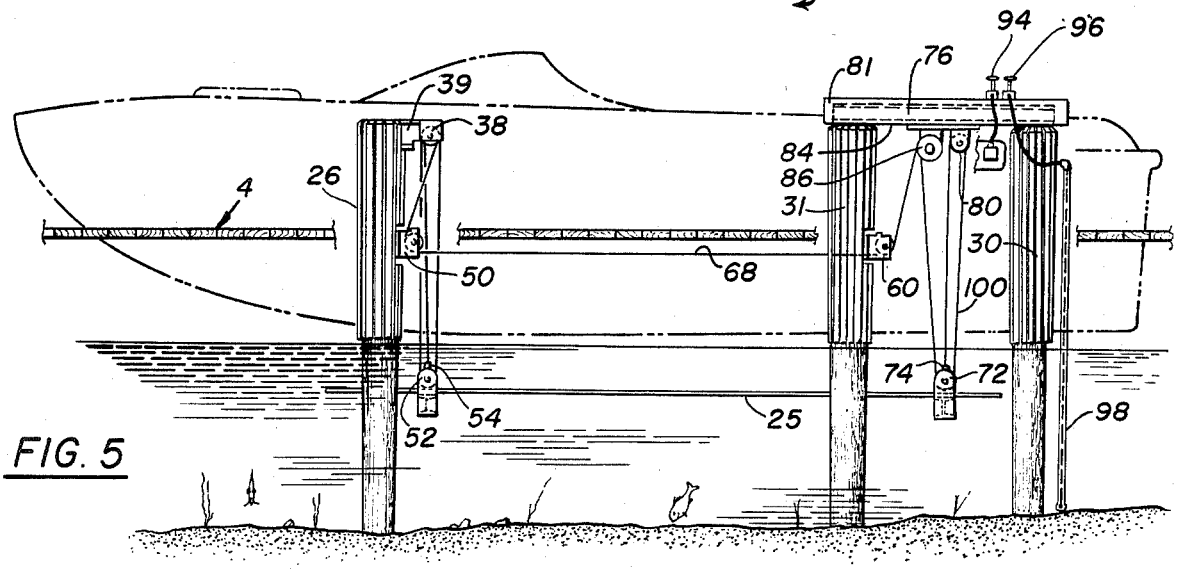
FIG. 5 is lateral view, partially in section, of the boat lift and berth of FIG. 1.

The use of the lift 2 is simply and highly effective. To berth and store the boat 8, it is led on the water 10 into the berth 4 through the piles 30 and 32 and forward through the other two pairs of piles 34/36 and 26/28 until it reaches a position as shown in phantom in FIG. 3 centered relative to the pad means 104 which have been previously adjusted vertically by the adjustment means 106 so that when the pad means 104 engages the underside of the hull 106, the boat 6 will be horizontal when lifted out of the water 10.

Figure 2:
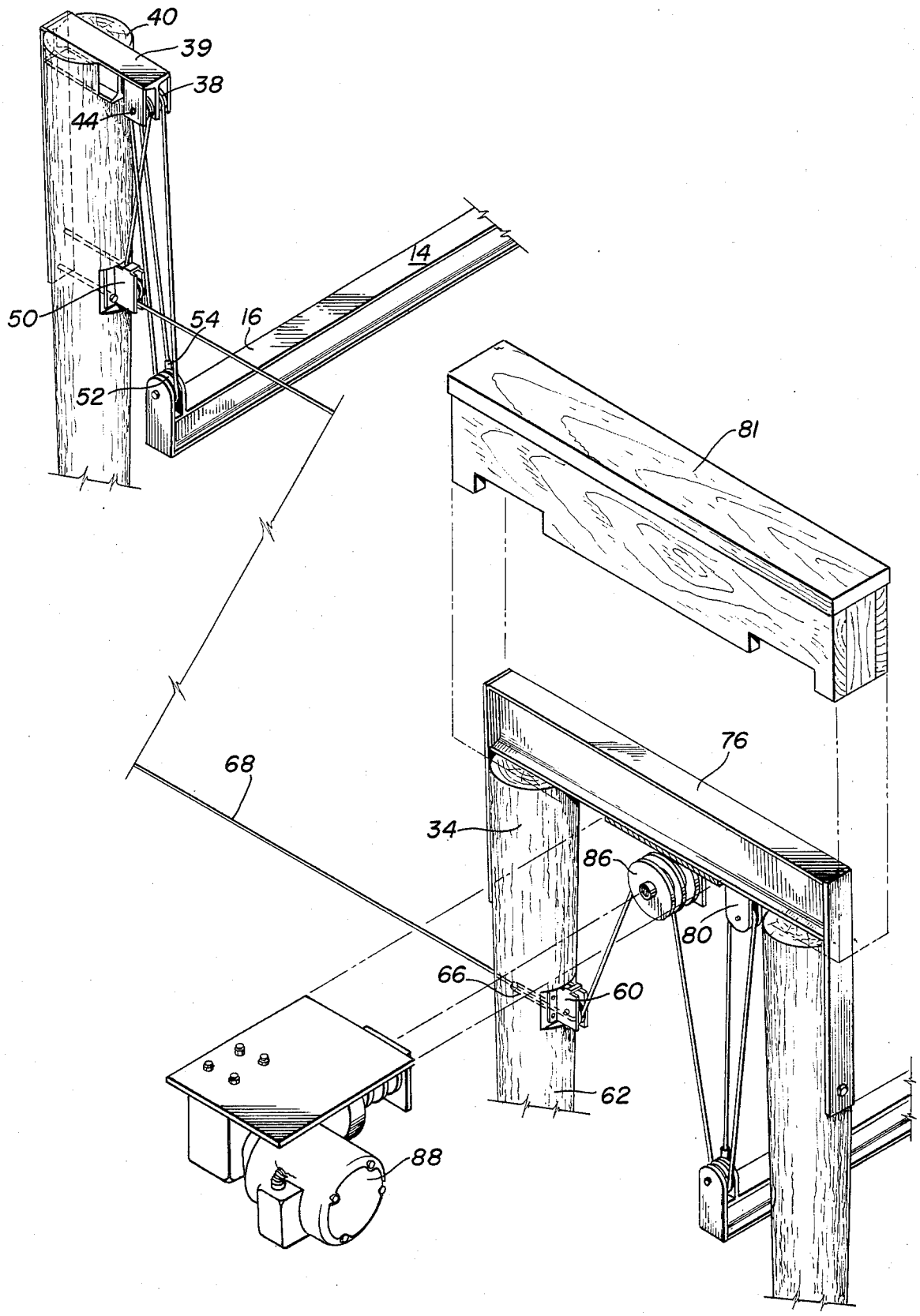
FIG. 2 is an exploded, fragmentary, perspective view of the inboard side of the boat lift shown in FIG. 1 (with the battens removed from the piles for the sake of clarity).

With the boat positioned as indicated, switch means 94 and 96 are operated so that winch drums 86 and 90 rotate cw. to tension the cables 68, 70, 100 and 102 and lift the boat 8 out of the water and into storage position as shown in FIG. 1.

When the boat is to be used, the switch means 94 & 96 are operated so that winch drums 86 and 90 rotate ccw. to pay out the cables 68, 70, 100 and 102 and lower the boat 8 into of the water so it may be moved out of the berth 4.

As will be apparent from FIG. 1, the new lifts 2 of the invention are distinguished for related prior art devices by the absence of large longitudinal support beams running fore and aft and/or transverse of the berth 4 or comparable extensive superstructure by which hoisting cables are suspended. This is made possible, in part, by the unique manner in which sheaves are utilized in the new lifts in combination with permanent piles to permit hoisting cables to be reeved in a manner in which the tension applied to the cables to effect the lifting of the boat is critically lower than in related prior art devices. Furthermore, none of the working parts of the new lifts remain submerged in water during the storage of boats on the lifts.

The embodiments of the invention in which an exclusive property or privilege is claimed are defined as follows:

1. In a boat lift associated with a berth that includes permanently positioned piles at least some of which are in pairs spaced apart in distance sufficient to permit the boat to be berthed thereat to move between said paired piles while in the water at said berth, the improvement which comprises:

a cradle upon which said boat can be supported out of said water, said cradle including a first transverse member having an inside end and outside end and a second transverse member spaced apart from said first member having an inside end and outside end, a first pair of said piles adjacent one end of said berth consisting of a first inside pile and a first outside pile, a second pair of said piles adjacent the other end of said berth consisting of a second inside pile and a second outside pile, a third pair of said piles positioned between said first and second pairs, closer to said second pair than said first pair, consisting of a third inside pile and a third outside pile, said inside piles being approximately aligned along an inside longitudinal axis and said outside piles being approximately aligned along an outside longitudinal axis, a pair of first inside sheaves mounted about at the top of said first inside pile on the side thereof facing said third inside pile to rotate about a shaft normal to said inside longitudinal axis, a pair of first outside sheaves mounted about at the top of said first outside pile on the side thereof facing said third outside pile to rotate about a shaft normal to said outside longitudinal axis, a second inside sheave mounted on said first inside pile below said first inside sheaves and above said water, a second outside sheave mounted on said first outside pile below said first outside sheaves and above said water, a third inside sheave and a first inside becket mounted on said inside end of said first transverse member, a third outside sheave and a first outside becket mounted on said outside end of said first transverse member, a fourth inside sheave mounted said third inside pile on the side thereof facing said second inside pile approximately on the horizontal plane of said second inside sheave, a fourth outside sheave mounted said third outside pile on the side thereof facing said second outside pile approximately on the horizontal plane of said second outside sheave, a bore in said third inside pile to permit a cable to pass from said third inside sheave to said fourth inside sheave, a bore in said third outside pile to permit a cable to pass from said third outside sheave to said fourth outside sheave, a fifth inside sheave and a second inside becket mounted on said inside end of said second transverse member, a fifth outside sheave and a second outside becket mounted on said outside end of said second transverse member, an inside horizontal beam supported between said second and third inside piles above said horizontal plane of said second inside sheave, an outside horizontal beam supported between said second and third outside piles above said horizontal plane of said second outside sheave, a sixth inside sheave carried by said inside beam adjacent said second inside pile on the bottom side side of said inside beam, a sixth outside sheave carried by said outside beam adjacent said second outside pile on the bottom side side of said outside beam, an inside motor driven winch drum carried on said inside beam between said sixth inside sheave and said third inside pile to rotate about an axis normal to said inside longitudinal axis, an outside motor driven winch drum carried on said outside beam between said sixth outside sheave and said third outside pile to rotate about an axis normal to said outside longitudinal axis, a cable reeved from said inside motor driven winch seriatim through said fourth inside sheave, said second inside sheave, said first inside sheave, said third inside sheave, said first inside sheave and terminating at said first inside becket, a cable reeved from said outside motor driven winch seriatim through said fourth outside sheave, said second outside sheave, said fourth outside sheave, said third outside sheave, said first outside sheave and terminating at said first outside becket, a cable reeved from said inside motor driven winch seriatim through said fifth inside sheave, said sixth inside sheave, and terminating at said second inside becket, and a cable reeved from said outside motor driven winch seriatim through said fifth outside sheave, said sixth outside sheave, and terminating at said second outside becket.

2. The boat lift of claim 1 wherein said transverse members carry support means to engage the hull of a boat to be lifted by said boat lift.

3. The boat lift of claim 2 wherein said support means includes hull engaging pad members and means to adjust the spacing of said pad members relative to said transverse members.

4. The boat lift of claim 1 wherein said motors of said driven winches are electric motors.

5. The boat lift of claim 4 wherein said inside horizontal beam carries electric switch means to control the operation of said electric motors.

6. In a boat lift associated with a berth that includes permanently positioned piles at least some of which are in pairs spaced apart a distance sufficient to permit the boat to be berthed thereat to move between said paired piles while in the water at said berth, the improvement which comprises:

a cradle upon which said boat can be supported out of said water, said cradle including a first transverse member having an inside end and outside end and a second transverse member spaced apart from said first member having an inside end and outside end, a first pair of said piles including first sheave means, a second pair of said piles including second sheave means, a third pair of said piles positioned between said first and second pairs adjacent said second second pair, each of said pair of piles having an inside pile and an outside pile, a first and second beams carried respectively by said inside and outside piles of said second and third pairs, first and second motor driven winch drums supported respectively upon said first and second beams, third sheave means carried by said first and second beams, first inside and outside cables reeved respectively from said first and second drums via said first and second sheave means forward to said inside and outside piles of said first pair to lift said first transverse member, and second inside and outside cables reeved respectively via said third sheave means from said first and second drums to lift said second transverse member.

* * * * *